US008654026B2

(12) United States Patent
Tsai et al.

(10) Patent No.: US 8,654,026 B2
(45) Date of Patent: Feb. 18, 2014

(54) ANTENNA MODULE

(75) Inventors: Wen-Yi Tsai, New Taipei (TW); Kuan-Jen Chung, New Taipei (TW); Chia-Wei Su, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 190 days.

(21) Appl. No.: 13/364,294

(22) Filed: Feb. 1, 2012

(65) Prior Publication Data

US 2013/0135167 A1 May 30, 2013

(30) Foreign Application Priority Data

Nov. 25, 2011 (TW) ..... 100222335 U

(51) Int. Cl.
*H01Q 19/00* (2006.01)
*H01Q 1/38* (2006.01)

(52) U.S. Cl.
USPC ..... 343/833; 343/700 MS; 343/817

(58) Field of Classification Search
None
See application file for complete search history.

(56) References Cited

U.S. PATENT DOCUMENTS

| | | | | |
|---|---|---|---|---|
| 6,707,428 | B2 * | 3/2004 | Gram | 343/700 MS |
| 7,439,916 | B2 * | 10/2008 | Wang et al. | 343/700 MS |
| 7,808,442 | B2 * | 10/2010 | Chiu et al. | 343/826 |
| 7,999,743 | B2 * | 8/2011 | Huber et al. | 343/700 MS |
| 2008/0246668 | A1 * | 10/2008 | Qi et al. | 343/702 |
| 2010/0048266 | A1 * | 2/2010 | Maruyama | 455/575.7 |
| 2011/0156960 | A1 * | 6/2011 | Tseng et al. | 343/700 MS |

* cited by examiner

*Primary Examiner* — Trinh Dinh
(74) *Attorney, Agent, or Firm* — Winston Hsu; Scott Margo

(57) ABSTRACT

An antenna module includes a substrate, a main radiation structure, a strip-shaped radiation structure, a grounding structure, a shorting structure, a parasitic radiation structure and a metal radiation member. An acute angle is included between a first edge of the main radiation structure and a longitudinal edge of the substrate. The main radiation structure has a signal feeding portion and a connecting portion. The strip-shaped radiation structure is extended from a second edge of the main radiation structure. The shorting structure is U-shaped. A first end of the shorting structure is connected to the signal feeding portion and a second end of the shorting structure is connected to the grounding structure. The parasitic radiation structure is extended from the grounding structure and parallel to the first edge. A constant distance is between the parasitic radiation structure and the first edge. The metal radiation member is connected to the connecting portion.

8 Claims, 6 Drawing Sheets

ANTENNA MODULE

RELATED APPLICATIONS

This application claims priority under 35 U.S.C. 119 from TAWAN Application No. 100222335 filed Nov. 25, 2011, the contents of which are incorporated herein by reference.

BACKGROUND OF THE INVENTION

1. Field of the Invention

The invention relates to an antenna module and, more particularly, to an antenna module capable of generating three operation bandwidths.

2. Description of the Prior Art

Wireless transmission has gotten more and more attention since portable electronic devices have become more and more popular. How to enhance transmission quality and how to apply various communication standards to one single electronic device are significant issues for wireless transmission. An electronic device in the prior art is used to perform different communication standards by independent antennas. Those antennas are always separated from each other as far as possible so as to prevent the antennas from interfering with each other. The aforesaid manner can be achieved in large device but is difficult to be achieved in small device (e.g. cell phone). Since the electronic device tends to multi-mode and small size, multiple antennas are developed accordingly. However, the multiple antennas occupy much more space since the isolation of the multiple antennas cannot be overcome easily and the multiple antennas are usually formed or disposed on the same substrate.

SUMMARY OF THE INVENTION

Therefore, an objective of the invention is to provide an antenna module capable of generating three operation bandwidths, so as to solve the aforesaid problems.

According to an embodiment of the invention, an antenna module comprises a substrate, a main radiation structure, a strip-shaped radiation structure, a grounding structure, a shorting structure, a parasitic radiation structure and a metal radiation member. The main radiation structure is formed on the substrate. An acute angle is included between a first edge of the main radiation structure and a longitudinal edge of the substrate. The main radiation structure has a signal feeding portion and a connecting portion. The strip-shaped radiation structure is formed on the substrate and extended from a second edge of the main radiation structure. The grounding structure is formed on the substrate. The shorting structure is formed on the substrate. The shorting structure is U-shaped. A first end of the shorting structure is connected to the signal feeding portion and a second end of the shorting structure is connected to the grounding structure. The parasitic radiation structure is formed on the substrate, extended from the grounding structure and parallel to the first edge, wherein a constant distance is between the parasitic radiation structure and the first edge. The metal radiation member is connected to the connecting portion.

As mentioned in the above, low bandwidth of the antenna module of the invention is controlled by the shorting structure. Since the shorting structure is U-shaped, high bandwidth of the antenna module can be maintained and raised and the shorting structure can cooperate with the strip-shaped structure to match GPS/GLONASS bandwidth. Furthermore, since a constant distance is between the parasitic radiation structure and the first edge of the main radiation structure and the parasitic radiation structure does not contact the main radiation structure, the antenna module of the invention can induce electromagnetic coupling between the parasitic radiation structure and the main radiation structure so as to match and modulate high bandwidth. Accordingly, the antenna of the invention can generate three operation bandwidths including LTE700/GSM850/GSM900 (bandwidth is about 698~960 MHz), GPS/GLONASS (bandwidth is about 1570~1610 MHz) and GSM1800/GSM1900/UMTS/LTE2300/LTE2500.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
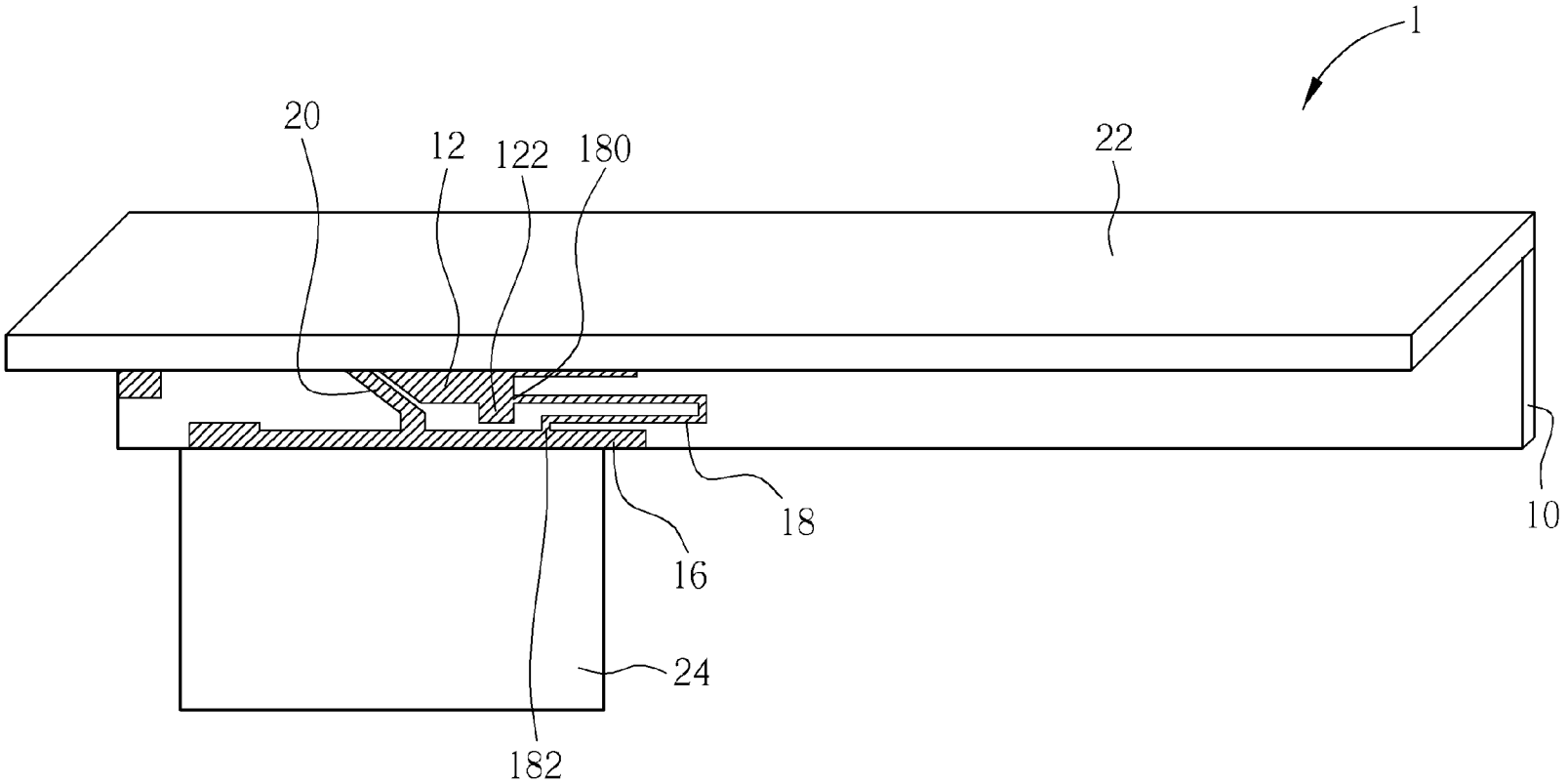
FIG. 1 is a schematic diagram illustrating an antenna module according to an embodiment of the invention.
Figure 2:
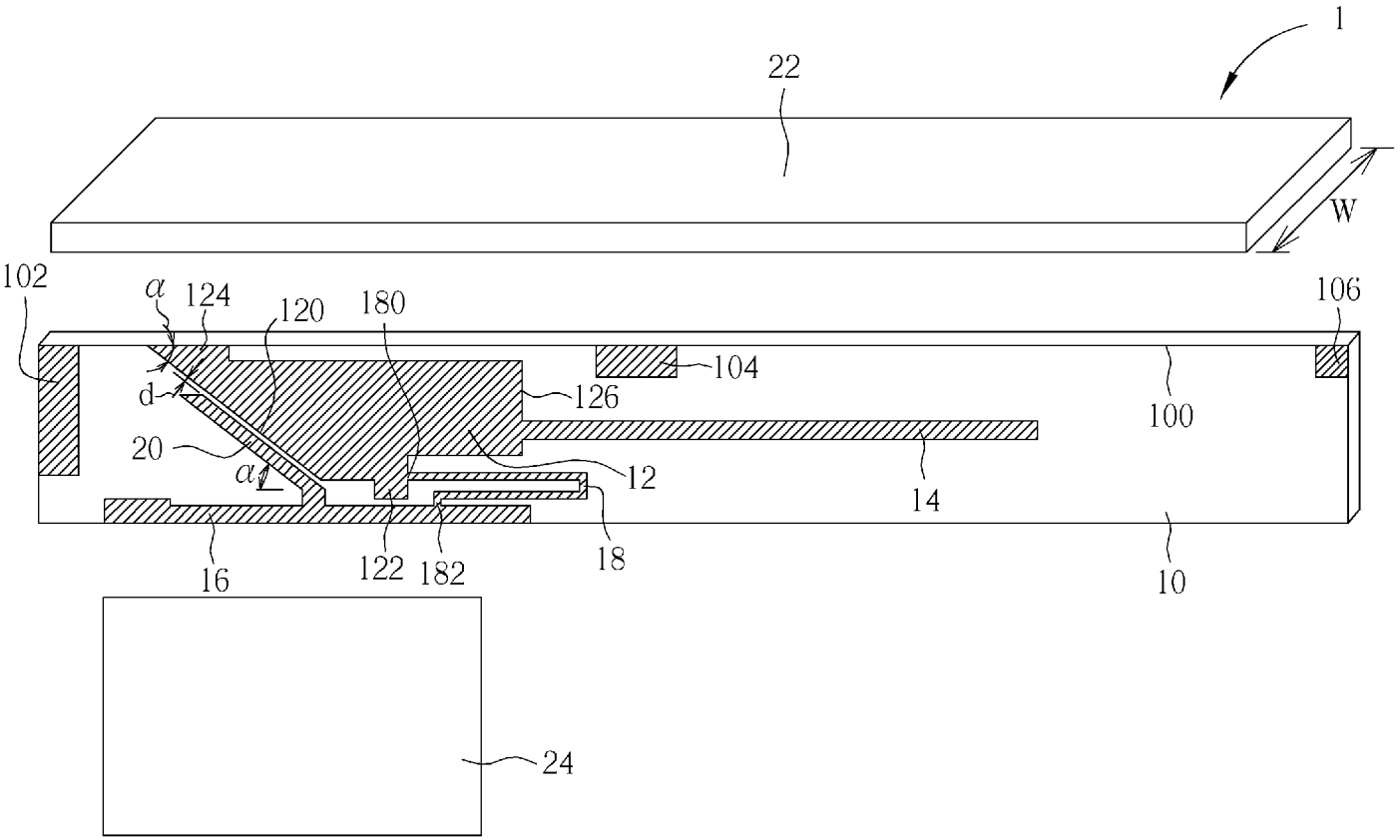
FIG. 2 is an exploded view illustrating the antenna module shown in FIG. 1.
Figure 3:
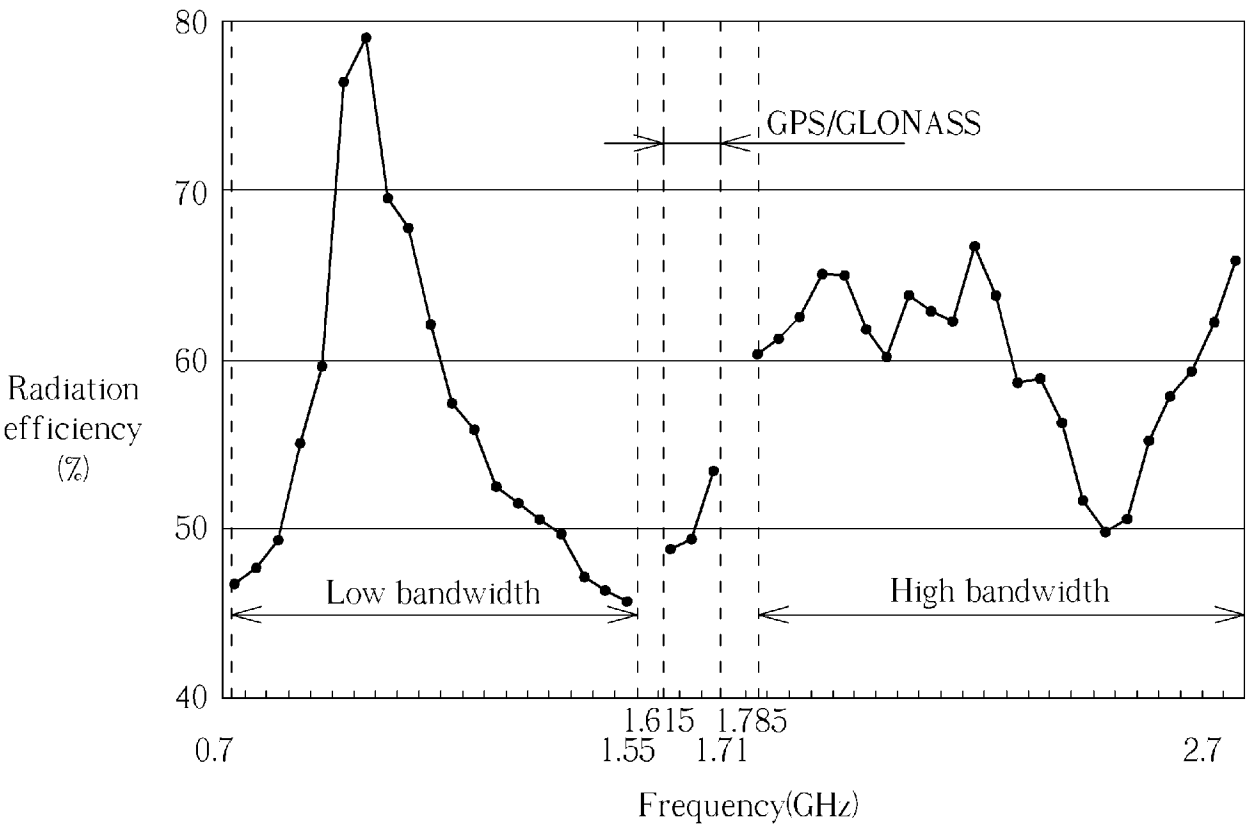
FIG. 3 is a diagram illustrating radiation efficiency of the antenna module shown in FIG. 1.

Referring to FIGS. 1 to 3, FIG. 1 is a schematic diagram illustrating an antenna module 1 according to an embodiment of the invention, FIG. 2 is an exploded view illustrating the antenna module 1 shown in FIG. 1, and FIG. 3 is a diagram illustrating radiation efficiency of the antenna module 1 shown in FIG. 1. As shown in FIGS. 1 and 2, the antenna module 1 comprises a substrate 10, a main radiation structure 12, a strip-shaped radiation structure 14, a grounding structure 16, a shorting structure 18, a parasitic radiation structure 20, a metal radiation member 22 and a metal sheet 24. In practical applications, the substrate 10 may be a circuit board. The main radiation structure 12, the strip-shaped radiation structure 14, the grounding structure 16, the shorting structure 18 and the parasitic radiation structure 20 are formed on the substrate 10. In practical applications, the main radiation structure 12, the strip-shaped radiation structure 14, the grounding structure 16, the shorting structure 18 and the parasitic radiation structure 20 may be formed on the substrate 10 by printing process.

An acute angle $\alpha$ is included between a first edge 120 of the main radiation structure 12 and a longitudinal edge 100 of the substrate 10. The main radiation structure 12 has a signal feeding portion 122 and a connecting portion 124. The strip-shaped radiation structure 14 is extended from a second edge 126 of the main radiation structure 12. The shorting structure 18 is U-shaped. A first end 180 of the shorting structure 18 is connected to the signal feeding portion 122 and a second end 182 of the shorting structure 18 is connected to the grounding structure 16. The parasitic radiation structure 20 is extended from the grounding structure 16 and parallel to the first edge 120 of the main radiation structure 12. A constant distance d is between the parasitic radiation structure 20 and the first edge 120 of the main radiation structure 12. Therefore, the acute angle α is also included between the parasitic radiation structure 20 and the longitudinal edge 100 of the substrate 10. The metal radiation member 22 is connected to the connecting portion 124 of the main radiation structure 12 and other connecting portions 102, 104, 106 on the substrate 10. In practical applications, the metal radiation member 22 may be connected to the connecting portion 124 of the main radiation structure 12 and other connecting portions 102, 104, 106 on the substrate 10 by soldering process. In this embodiment, the metal radiation member 22 is perpendicular to the substrate 10 and a width W of the metal radiation member 22 is larger than 4 mm. Accordingly, the antenna module 1 of the invention can get better radiation efficiency. Furthermore, the metal sheet 24 is connected to the grounding structure 16 so as to enhance grounding performance between the antenna module 1 and a product (not shown).

As shown in FIG. 2, a grounding point (i.e. the second end 182 connected to the grounding structure 16) of the shorting structure 18 is very close to the signal feeding portion 122, but a grounding point of a shorting structure of conventional planar inverted F (PIFA) or IFA antenna is very far away from the signal feeding portion. Moreover, the shorting structure 18 is strip-shaped and U-shaped such that the antenna module 1 can match three operation bandwidths including LTE700/GSM850/GSM900 (bandwidth is about 698~960 MHz), GPS/GLONASS (bandwidth is about 1570~1610 MHz) and GSM1800/GSM1900/UMTS/LTE2300/LTE2500, as shown in FIG. 3. In this embodiment, low bandwidth of the antenna module 1 is controlled by the shorting structure 18. Since the shorting structure 18 is U-shaped, high bandwidth of the antenna module 1 can be maintained and raised and the shorting structure 18 can cooperate with the strip-shaped structure 14 to match GPS/GLONASS bandwidth.

Figure 4:
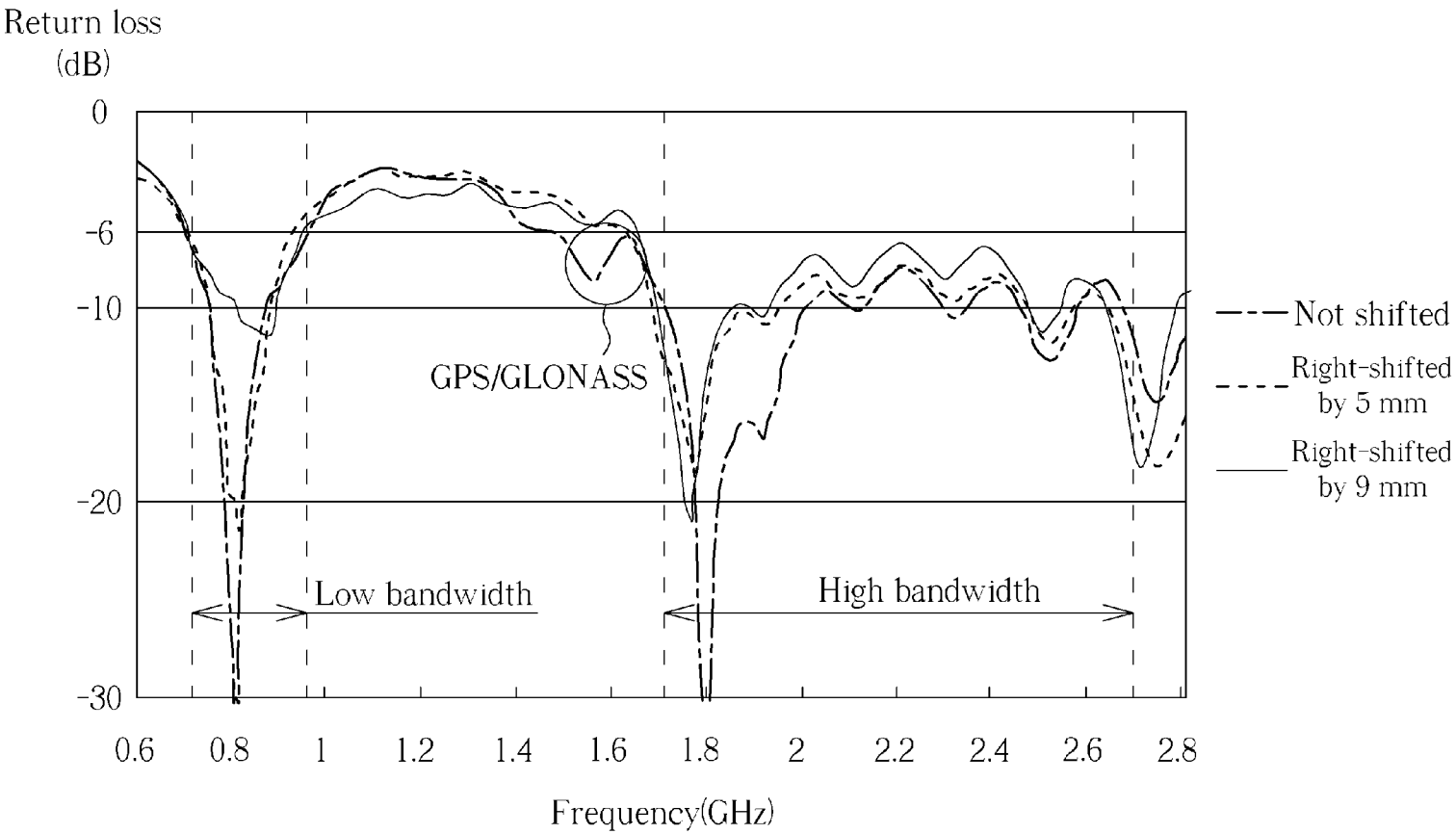
FIG. 4 is a diagram illustrating relations between return loss and frequency while the second end of the shorting structure is connected to different positions of the grounding structure.

Referring to FIG. 4, FIG. 4 is a diagram illustrating relations between return loss and frequency while the second end 182 of the shorting structure 18 is connected to different positions of the grounding structure 16. Provided that the total length of the shorting structure 18 of the invention is constant and equal to about 21.5 mm and the second end 182 of the shorting structure 18 is located at three positions including "not shifted" (i.e. the position shown in FIG. 2), "right-shifted by 5 mm" and "right-shifted by 9 mm", wherein when the second end 182 of the shorting structure 18 is right-shifted by 9 mm, the shorting structure 18 is pulled to be L-shaped from U-shaped. As shown in FIG. 4, once the impedance of the U-shaped shorting structure 18 disappears, three bandwidths of the antenna module 1 will get worse correspondingly. Especially, GPS/GLONASS bandwidth cannot be matched well due to the loss of impedance of the original U-shaped shorting structure 18. In this embodiment, a distance between the second end 182 of the shorting structure 18 and the signal feeding portion 122 can be fine adjusted between 1 mm and 5 mm so as to obtain better radiation efficiency.

Figure 5:
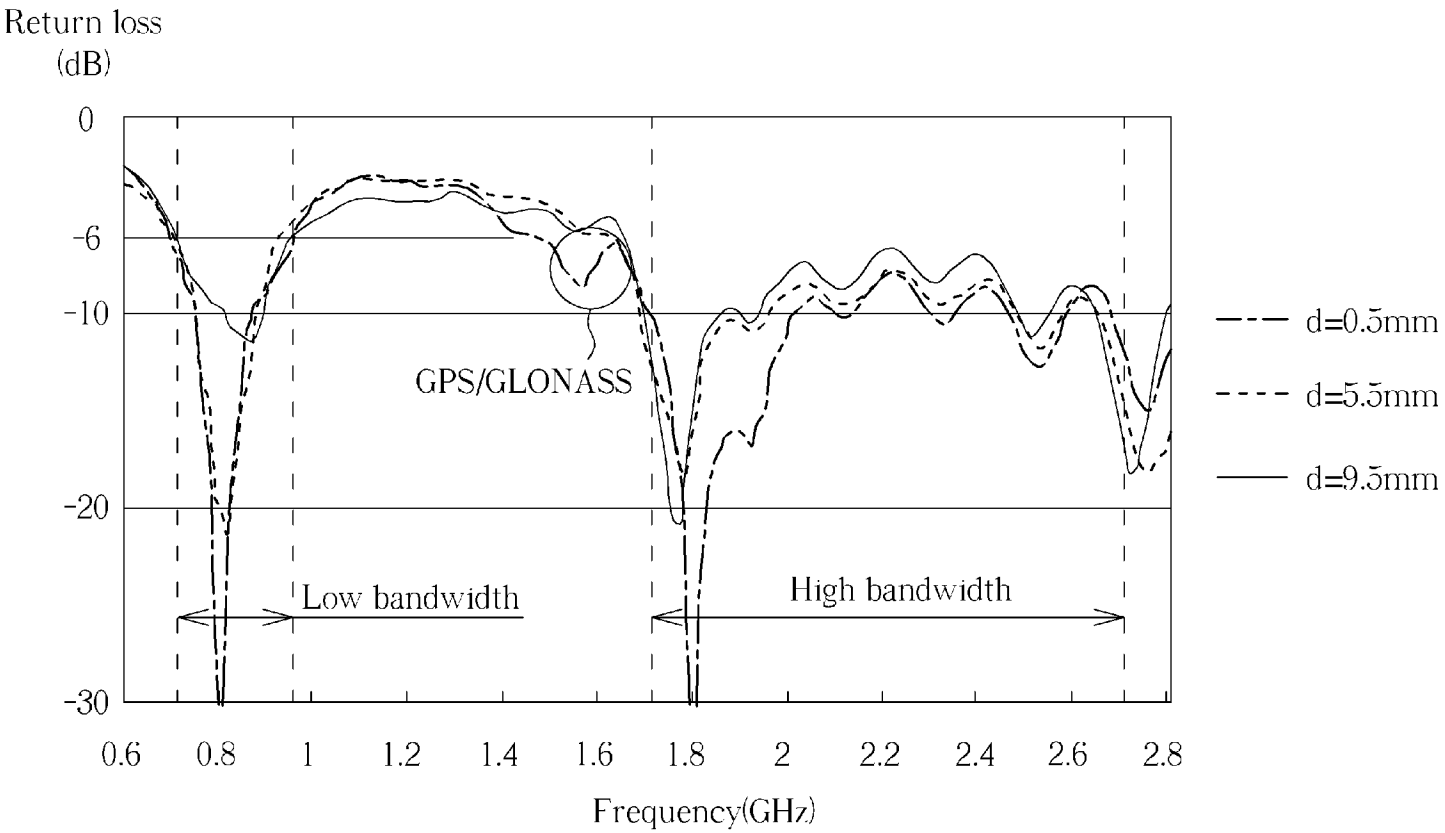
FIG. 5 is diagram illustrating relations between return loss and frequency while the constant distance between the parasitic radiation structure and the main radiation structure changes.
Figure 6:
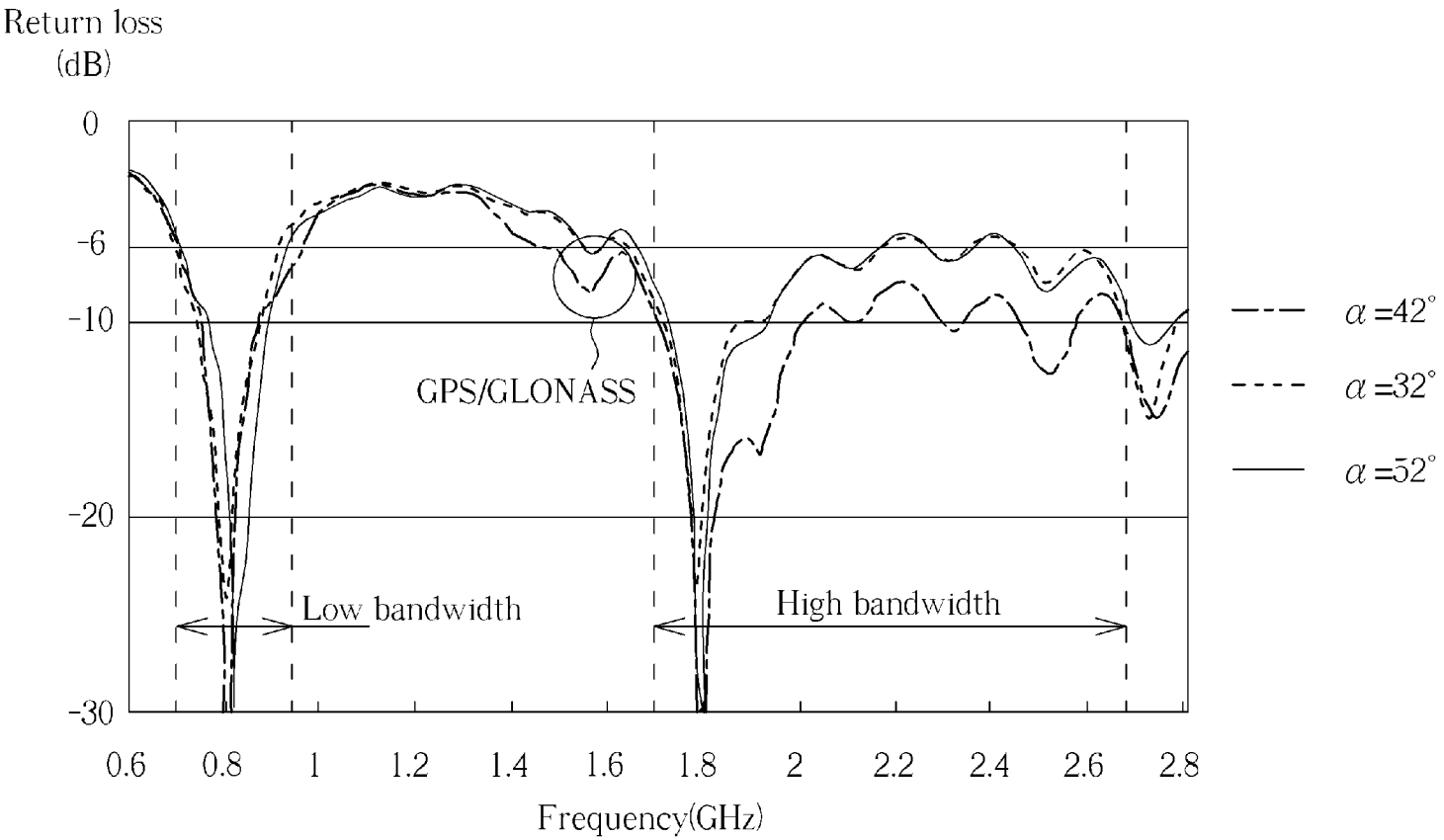
FIG. 6 is diagram illustrating relations between return loss and frequency while the acute angle of the parasitic radiation structure changes.

The parasitic radiation structure 20 is used for matching high bandwidth. The length of the parasitic radiation structure 20 may be increased or decreased to adjust high frequency of the antenna module 1 according to design requirement or, alternatively, the constant distance d between the parasitic radiation structure 20 and the main radiation structure 12 and/or the acute angle α may be adjusted to control high frequency impedance. Referring to FIGS. 5 and 6, FIG. 5 is diagram illustrating relations between return loss and frequency while the constant distance d between the parasitic radiation structure 20 and the main radiation structure 12 changes, and FIG. 6 is diagram illustrating relations between return loss and frequency while the acute angle α of the parasitic radiation structure 20 changes. As shown in FIG. 5, when the constant distance d is equal to 0.5 mm, high bandwidth can be matched better than others. Once the constant distance d increases, high bandwidth will get worse correspondingly. As shown in FIG. 6, in view of a bending angle of the parasitic radiation structure 20, the optimal acute angle α is 42 degrees. Once the parasitic radiation structure 20 rotates 10 degrees clockwise or counterclockwise, high bandwidth of the antenna module 1 will get worse due to variation of the acute angle α. In this embodiment, the acute angle α can be fine adjusted between 40 degrees and 44 degrees and the constant distance d can be fine adjusted between 0.5 mm and 1.5 mm, so as to obtain better radiation efficiency.

Compared with the prior art, low bandwidth of the antenna module of the invention is controlled by the shorting structure. Since the shorting structure is U-shaped, high bandwidth of the antenna module can be maintained and raised and the shorting structure can cooperate with the strip-shaped structure to match GPS/GLONASS bandwidth. Furthermore, since a constant distance is between the parasitic radiation structure and the first edge of the main radiation structure and the parasitic radiation structure does not contact the main radiation structure, the antenna module of the invention can induce electromagnetic coupling between the parasitic radiation structure and the main radiation structure so as to match and modulate high bandwidth. Accordingly, the antenna of the invention can generate three operation bandwidths including LTE700/GSM850/GSM900 (bandwidth is about 698~960 MHz), GPS/GLONASS (bandwidth is about 1570~1610 MHz) and GSM1800/GSM1900/UMTS/LTE2300/LTE2500.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna module comprising:

a substrate;

a main radiation structure formed on the substrate, an acute angle being included between a first edge of the main radiation structure and a longitudinal edge of the substrate, the main radiation structure having a signal feeding portion and a connecting portion;

a strip-shaped radiation structure formed on the substrate and extended from a second edge of the main radiation structure;

a grounding structure formed on the substrate;

a shorting structure formed on the substrate, the shorting structure being U-shaped, a first end of the shorting structure being connected to the signal feeding portion and a second end of the shorting structure being connected to the grounding structure;

a parasitic radiation structure formed on the substrate, extended from the grounding structure and parallel to the first edge, a constant distance being between the parasitic radiation structure and the first edge; and a metal radiation member connected to the connecting portion.

2. The antenna module of claim 1, wherein the acute angle is between 40 degrees and 44 degrees.

3. The antenna module of claim 1, wherein the strip-shaped radiation structure is used for matching GPS/GLONASS bandwidth.

4. The antenna module of claim 1, wherein a distance between the second end and the signal feeding portion is between 1 mm and 5 mm.

5. The antenna module of claim 1, wherein the constant distance is between 0.5 mm and 1.5 mm.

6. The antenna module of claim 1, wherein the metal radiation member is perpendicular to the substrate.

7. The antenna module of claim 1, wherein a width of the metal radiation member is larger than 4 mm.

8. The antenna module of claim 1 further comprising a metal sheet connected to the grounding structure.

* * * * *